US006293472B1

(12) United States Patent
Yano

(10) Patent No.: US 6,293,472 B1
(45) Date of Patent: Sep. 25, 2001

(54) EXPANSION VALVE

(75) Inventor: Masamichi Yano, Tokyo (JP)

(73) Assignee: Fujikoki Corporation, Tokyo (JP)

( * ) Notice: Subject to any disclaimer, the term of this patent is extended or adjusted under 35 U.S.C. 154(b) by 0 days.

(21) Appl. No.: 09/179,885

(22) Filed: Oct. 28, 1998

(30) Foreign Application Priority Data

Feb. 10, 1998 (JP) ..... 10-028039

(51) Int. Cl.[7] ..... F25B 41/04
(52) U.S. Cl. ..... 236/92 B; 62/225
(58) Field of Search ..... 62/225; 236/92 B

(56) References Cited

U.S. PATENT DOCUMENTS

| | | | | |
|---|---|---|---|---|
| 3,450,345 | * | 6/1969 | Orth et al. | 62/225 |
| 3,640,311 | | 2/1972 | Gotzenberger | 137/637.4 |
| 5,026,022 | | 6/1991 | Bastle | 251/122 |
| 5,257,737 | * | 11/1993 | Vestergaard | 62/225 |
| 5,303,864 | * | 4/1994 | Hirota | 62/225 |
| 5,957,376 | * | 9/1999 | Rujimoto et al. | 62/225 |
| 5,961,038 | * | 10/1999 | Okada | 62/225 |

FOREIGN PATENT DOCUMENTS

| | | |
|---|---|---|
| 91 10 384 U | 1/1992 | (DE) . |
| 0 306 113 A | 3/1990 | (EP) . |
| 0 664 425 A | 7/1995 | (EP) . |
| 0 691 517 A | 1/1996 | (EP) . |
| 0 836 061 A1 | 4/1998 | (EP) . |
| 0 864 826 A2 | 9/1998 | (EP) . |
| 0 871 000 A1 | 10/1998 | (EP) . |
| 02 154955 | 6/1990 | (JP) . |
| 09 089154 | 3/1997 | (JP) . |

* cited by examiner

*Primary Examiner*—William E. Tapolcai
(74) *Attorney, Agent, or Firm*—Armstrong, Westerman, Hattori, McLeland & Naughton, LLP

(57) ABSTRACT

A power element portion 36' mounted on the upper portion of an expansion valve body comprises an upper cover **36*d* and a lower cover 36*h*, and is divided into an upper pressure chamber 36*b* and a lower pressure chamber 36*c* by a diaphragm 36*a*. A heat sensing drive shaft 101 is formed of a large radius portion 105 and a heat conducting shaft 103 integrally formed thereto. The stopper portion 104 contacting the lower surface of the diaphragm 36*a* is a member which is formed separately from the heat sensing drive shaft 101, and supported within the lower cover 36*h*. When the expansion valve is taken apart, the heat sensing drive shaft 101 is pulled out from the inside of the mounting seat 362 of the power element portion 36', and the refrigerant remaining inside the upper pressure chamber 36*b*** is taken out and collected from the side of the diaphragm.

6 Claims, 17 Drawing Sheets

(A)

(B)

(A)

(B)

(A)

(B)

EXPANSION VALVE

BACKGROUND OF THE INVENTION

The present invention relates to an expansion valve for controlling the flow rate of a refrigerant supplied to an evaporator in a refrigeration cycle of an air conditioning device, a refrigerating device and the like.

This type of expansion valve is used in a refrigeration cycle of an air conditioning device of a vehicle and the like, wherein FIG. 15 is a vertical cross-sectional view of one example of an expansion valve widely used conventionally shown together with an outline of the refrigeration cycle, and FIG. 16 shows the main portion thereof. The expansion valve 10 includes a roughly prismatic-shaped aluminum valve body 30 comprising a first passage 32 mounted in a refrigerant duct 11 of the refrigeration cycle from a refrigerant exit of a condenser 5 through a receiver 6 to a refrigerant entrance of an evaporator 8 through which a liquid-phase refrigerant travels, and a second passage 34 mounted in the refrigerant duct 11 from a refrigerant exit of the evaporator 8 to a refrigerant entrance of a compressor 4 through which a gas-phase refrigerant travels, said first passage 32 and said second passage 34 positioned above or below one another and separated by a separation wall 38*f*.

On the first passage 32 is formed an orifice 32*a* for performing an adiabatic expansion of the liquid refrigerant being supplied from the refrigerant exit of the receiver 6. A valve seat is formed on the entrance side of the orifice 32*a* or upper stream side of the first passage, and a valve 32*b* having a spherical shape supported by a valve member 32*c* from the upper stream side is positioned on said valve seat, wherein the valve 32*b* and the valve member 32*c* are fixed together by welding. The valve member 32*c* is positioned between the valve and a biasing means 32*d* of a compression spring and the like mounted on the lower portion of the valve body, and transmits the biasing force of the biasing means 32*d* to the valve 32*b*. The valve 32*b* is biased in the direction approaching the valve seat.

The first passage 32 to which the liquid refrigerant from the receiver 6 is introduced works as a passage for the liquid refrigerant, which comprises an entrance port 321 and a valve chamber 35 connected to the entrance port 321. The valve chamber 35 is a chamber with a bottom formed coaxial to the orifice 32*a*, which is sealed by a plug 39. The valve chamber 35 is communicated to the exit port 322 through the orifice 32*a*, and the exit port 322 is connected to the refrigerant entrance of the evaporator 8.

Further, the valve body 30 includes a small radius hole 37 and a large radius hole 38 having a larger radius than the hole 37 formed coaxial to the orifice 32*a* and penetrating the second passage 34, so as to provide a driving force to the valve 32*b* and to open or close the orifice 32*a* in correspondence to the exit temperature of the evaporator 8. On the upper end of the valve body 30 is formed a screw hole 361 where a power element portion 36 working as a heat sensing portion is fixed.

The power element portion 36 is a member driven in correspondence to pressure, comprising a diaphragm 36*a* which is a metallic thin plate made of stainless steel with flexibility, an upper cover 36*d* and a lower cover 36*h* made of stainless steel mounted so as to contact each other with the diaphragm 36*a* positioned therebetween and working as sealing walls each defining a pressure chamber, an upper pressure chamber 36*d* and a lower pressure chamber 36*c*, having said diaphragm as one wall surface and divided into the upper and lower chambers by the diaphragm, and a blind plug 36*i* made of stainless steel for filling a predetermined refrigerant for sensing temperature and working as a diaphragm driving medium into said upper pressure chamber 36*b*, wherein said lower pressure chamber 36*c* is communicated to the second passage 34 through a pressure equalization hole 36*e* formed concentric to the center line of the orifice 32*a*. A refrigerant steam from the evaporator 8 flows through the second passage 34, and the passage 34 works as a passage for the gas-phase refrigerant, the pressure of said gas-phase refrigerant being loaded to the lower pressure chamber 36*c* through the pressure equalization hole 36*e*. Further, a pipe-like mounting seat 362 is formed on the lower cover 36*h*, the mounting seat 362 being screwed onto the screw hole 361, thereby being fixed to the valve body 30.

The present body further includes a heat sensing shaft 36*f* made of aluminum, which contacts the diaphragm 36*a* inside the lower pressure chamber 36*c* and positioned so as to penetrate the second passage 34 and mounted slidably inside the large radius hole 38 in the separation hole 38*f*, thereby communicating the refrigerant exit temperature of the evaporator 8 to the lower pressure chamber 36*c*, and at the same time, provides drive force by being slided inside the large radius hole in correspondence to the displacement of the diaphragm 36*a* accompanied by the pressure difference between the upper pressure chamber 36*b* and the lower pressure chamber 36*c*. The body further includes an operation shaft 37*f* made of stainless steel positioned slidably inside the small radius hole 37 and having a smaller radius than the heat sensing shaft 36*f* for pressing the valve 32*b* against the bias force of the biasing means 32*d* in correspondence to the displacement of the heat sensing shaft 36*f*. The heat sensing shaft 36*f* is equipped with a sealing member for securing the sealing ability between the first passage 32 and the second passage 34, such as an o-ring 36*g*. An upper end portion 36*k* of the heat sensing shaft 36*f* contacts the lower surface of the diaphragm 36*a* as a receiving portion, and comprises a stopper portion 36L enlarged to the radial direction so as to gain a large contact area with the diaphragm. The displacement of the diaphragm 36*a* is transmitted to the valve 32*b* through the heat sensing shaft 36*f*, and the stopper portion 36L is supported by the lower cover 36*h* so that the upper end portion 36*k* of the heat sensing shaft 36*f* may be slid inside the lower pressure chamber 36*c*.

Moreover, the lower end of the heat sensing shaft 36*f* contacts the upper end of the operation shaft 37*f* at the bottom portion of the large radius hole 38 and the lower end of the operation shaft contacts the valve 32*b*. The heat sensing shaft 36*f* together with the operation shaft 37*f* form a heat sensing drive shaft, and this heat sensing drive shaft acts as a valve drive shaft for transmitting the displacement of the diaphragm 36*a* to the valve 32*b*, which comprises of an upper end portion and a heat conducting portion.

In the structure of the power element portion 36, the heat sensing shaft 36*f* and the operation shaft 37*f*, when the operation shaft 37*f* is inserted to the small radius hole 37 and the heat sensing shaft 36*f* is inserted to the large radius hole 38, the mounting seat 362 on the lower cover 36*h* is fixed by being connected to a screw hole 361, the seal between the lower cover 36*h* and the valve body 30 being secured by the o-ring 36*m*. The screw hole 361 together with the lower cover 36*h* and the diaphragm 36*a* form the lower pressure chamber 36*c*.

Accordingly, on the pressure equalization hole 36*e*, a valve drive shaft extended from the lower surface of the diaphragm 36*a* to the orifice 32*a* of the first passage 32 is concentrically positioned. Further, the portion 37*e* of the operation shaft 37*f* is formed smaller (narrower) than the inner radius of the orifice 32*a* so as to be inserted through the orifice 32*a*, and thereby, the refrigerant may pass through the orifice 32*a*.

FIG. 16(A) is a schematic view showing the structure of the power element portion 36 and the heat sensing shaft 36*f* in the expansion valve 10 explained above, and FIG. 16(B) is a view taken from the direction of the arrow of FIG. 16(A), showing the state where the lower cover 36*h* is rotated and removed from the screw hole 361, so that the power element portion 36 and the heat sensing shaft are separated. FIG. 16(C) is a vertical cross-sectional view showing the structure of the power element portion 36 and the heat sensing shaft 36*f*. In the above structure, a predetermined refrigerant for sensing temperature is filled inside the upper pressure chamber 36*b* of the pressure housing 36*d* as a diaphragm drive medium (for example, the same gas as the refrigerant gas used in the refrigeration cycle), and the temperature of the refrigerant coming out from the refrigerant exit of the evaporator 8 and flowing through the second passage 34 is transmitted to the diaphragm drive medium through the diaphragm 36*a* and the heat sensing shaft 36*f* exposed to the second passage 34 or the pressure equalization hole 36*e* communicated to the second passage 34.

The diaphragm drive medium inside the upper pressure chamber 36*b* changes into gas in correspondence to the temperature being transmitted thereto, thereby changing the pressure inside said chamber which is loaded to the upper surface of the diaphragm 36*a*. The diaphragm 36*a* is vertically displaced by the difference between the pressure of the diaphragm drive gas loaded to the upper surface thereof and the pressure loaded to the lower surface thereof.

The displacement of the center area of the diaphragm 36*a* in the vertical direction is transmitted to the valve 32*b* through the heat sensing drive shaft, and moves the valve 32*b* close to or away from the valve seat of the orifice 32*a*. As a result, the flow path area of the orifice 32*a* is changed, and the flow rate of the refrigerant is controlled.

In other words, the heat sensing shaft 36*f* positioned inside the second passage 34 connected to the exit side of the evaporator 8 transmits the temperature of the low-pressure gas-phase refrigerant sent out from the evaporator to the upper pressure chamber 36*b*, and corresponding to the temperature, the pressure inside the upper pressure chamber 36*b* is changed. When the exit temperature of the evaporator 8 is high or heat load of the evaporator is increased, the pressure inside the upper pressure chamber 36*b* is raised, and in response, the heat sensing shaft 36*f* or heat sensing drive shaft is driven to the lower direction so as to lower the valve 32*b*, thereby increasing the opening of the orifice 32*a*. Accordingly, the quantity of the refrigerant supplied to the evaporator 8 will be increased, thereby lowering the temperature of the evaporator 8. In contrast, if the temperature of the refrigerant sent out from the evaporator 8 is decreased or heat load of the evaporator is decreased, the valve 32*b* is driven to the opposite direction, and the opening of the orifice 32*a* is decreased. Accordingly, the quantity of the refrigerant supplied to the evaporator 8 will be decreased, thereby increasing the temperature of the evaporator 8.

Similar to the expansion valve of the prior art shown in FIG. 15, FIG. 17 shows an expansion valve according to the prior art comprising a valve positioned to oppose to an orifice formed in the middle of a high-pressure refrigerant passage through which a high-pressure refrigerant sent into the evaporator travels, wherein the valve is driven to open or close in correspondence to the temperature of the low-pressure refrigerant sent out from the evaporator.

FIG. 17 is a vertical cross-sectional view showing the prior art expansion valve, and FIG. 18 is a drawing showing the main portion of FIG. 17. In FIG. 17, the same reference numbers as the prior art expansion valve of FIG. 15 show either the same or similar portions, but the structure of the heat sensing drive shaft differs from that shown in FIG. 15. In the expansion valve 101 shown in FIG. 17, the valve body 30 comprises a similar valve body as in the example shown in FIG. 15, and basically comprises an orifice 32*a* formed in a high-pressure refrigerant passage 32 through which a high-pressure refrigerant to be sent into the evaporator 8 travels, a spherical valve 32*b* positioned so as to oppose to said orifice 32*a* from the upper stream side of said refrigerant, a biasing means 32*d* for biasing said valve toward said orifice from the upper stream side, a valve member 32*c* positioned between said biasing means and said valve so as to transmit the biasing force of said biasing means to said valve 32*b*, a power element portion 36 driven in correspondence to the temperature of the low-pressure refrigerant sent out from said evaporator, and a heat sensing drive shaft or rod portion inserted through said orifice comprising a heat sensing shaft and an operation shaft formed integrally and positioned between said power element portion 36 and said valve 32*b*, wherein said valve could be driven close to or away from said orifice by said rod portion according to the movement of said power element portion, so that the flow rate of the refrigerant passing through the orifice may be controlled.

The heat sensing drive shaft 318 comprises a separately formed upper end portion 36*k* and an integrally formed heat sensing shaft and operation shaft as, for example, a stainless steel rod portion 316 having a small radius. The upper end portion 36*k* acts as a receiving portion contacted to the lower surface of the diaphragm 36*a*, comprising a stopper portion 312 enlarged to the radial direction and a large radius portion 314 whose other end portion forms a protrusion 315 on the center thereof and inserted slidably to the lower pressure chamber 36*c*. Further, the upper end of the rod portion 316 is connected to the interior of the protrusion 315 on the large radius portion 314, and the lower end thereof contacts the valve 32*b*.

The rod portion 316 forming the heat sensingshaft is driven vertically traversing the passage 34 in correspondence to the displacement of the diaphragm 36*a* in the power element portion 36, so a clearance communicating the passage 322 and the passage 34 may be formed along the rod portion 316. In order to prevent such communication, an o-ring 40 contacted to the outer peripheral of the rod portion 316 is positioned inside the large radius hole 38, so that the o-ring exists between the two passages. Moreover, as a detent for preventing the o-ring 40 from moving by the force operating in the longitudinal direction (the direction of the power element portion 36) by the refrigerant pressure of the passage 321 and the coil spring 32*d*, a washer or snap ring with teeth 41 is positioned inside the large radius hole 38 contacting the o-ring 40 so as to fix the o-ring. The rod portion 316 is formed for example by stainless steel, having a diameter of approximately 2.4 mm, and the portion where the orifice 32*a* of the rod portion 316 is inserted is formed to have a diameter of approximately 1.6 mm.

In the prior art example shown in FIG. 16, the stopper portion 312 and the large radius portion 314 may be formed of brass, and the rod portion 316 may be formed of aluminum. Further, the stopper portion, the large radius portion and the rod portion may all be formed of stainless steel. In the prior art expansion valve shown in FIG. 18, the displacement of the diaphragm 36*a* is transmitted by the rod portion 316 to the spherical valve 32*b*, which moves the valve 32*b* close to or away from the orifice 32*a* so as to control the flow rate of the refrigerant, which is similar to the example shown in FIG. 15.

Further, similar to the expansion valve of FIG. 15, the valve shown in FIG. 17 is also filled with a predetermined refrigerant by use of a plug body 36*i*. The plug body 36*i* made for example of stainless steel is inserted so as to cover the hole 36*j* formed on the stainless steel upper cover 36*d* and fixed thereto by welding.

FIG. 18(A) shows a schematic view of the structure of the power element portion 36 of the expansion valve 101 explained above, and FIG. 18(B) is a view taken from the direction of the arrow of FIG. 18(A), wherein the lower cover 36*h* is rotated and removed from the screw hole 361, separating the power element portion 36. FIG. 18(C) is a cross-sectional view showing the structure of the power element portion 36.

SUMMARY OF THE INVENTION

In the prior art expansion valve, a material such as aluminum, stainless steel or brass and the like are used as the metal material. In the recent years, the recycling of materials are strongly requested from the point of saving resources. In the prior art expansion valve, it was easy to recycle metal material when the expansion valve was formed by the same kind of metal. However, when various metal materials were used in the expansion valve, for example, stainless steel material for the diaphragm and aluminum material for the heat sensing drive shaft, it was difficult to recycle each metal material unless these various materials were segregated. Especially, in the prior art expansion valve, there was a problem that no consideration was made on recycling each metal material.

Moreover, there is a strong request from the point of view of the protection of earth environment that the refrigerant used in the refrigeration cycle should be collected without being discharged into the atmosphere. The prior art expansion valve had such refrigerant filled inside the pressure chamber of the power element portion as the diaphragm drive medium for displacing the diaphragm according to the change of pressure.

However, in the expansion valve of the prior art, there was a problem that no consideration was made on the collection of such refrigerant therefrom.

Therefore, the object of the present invention is to provide an expansion valve solving the problems of the prior art expansion valve by enabling recycling without having to change the structure drastically.

Moreover, the present invention aims at providing an expansion valve whose refrigerant could also be collected accompanying said recycling.

In order to solve the problem, the expansion valve according to the present invention has a diaphragm forming one portion of a sealing wall in a power element portion filled with a heat sensing refrigerant, and a valve driven in correspondence to the displacement of said diaphragm by a heat sensing drive shaft for changing the flow path area of an orifice through which a high-pressure refrigerant to be sent to an evaporator travels:

wherein said heat sensing drive shaft includes a stopper portion contacted to said diaphragm, said shaft being formed so as to be separated from said power element portion by leaving said stopper portion inside said power element portion.

Further, the expansion valve according to the present invention comprises a valve body having a first passage through which a high-pressure refrigerant travels and a second passage through which a low-pressure refrigerant travels, a valve positioned inside said valve body for controlling the flow of the refrigerant traveling through said first passage, a power element portion mounted to the upper end portion of said valve body, a biasing means positioned in the lower portion of said valve body for biasing said valve, and a heat sensing drive shaft mounted between said power element portion and said valve, wherein said power element portion comprises an upper pressure chamber and a lower pressure chamber divided by a diaphragm mounted in the interior thereof; said drive shaft comprises a stopper portion formed on the upper end portion thereof for contacting to said diaphragm; and said drive shaft is formed to separate by leaving said stopper portion inside said lower pressure chamber.

Moreover, the expansion valve according to the present invention has a diaphragm forming one portion of a sealing wall in a power element portion filled with a heat sensing refrigerant, and a valve driven in correspondence to the displacement of said diaphragm by a heat sensing drive shaft for changing the flow path area of an orifice through which a high-pressure refrigerant to be sent to an evaporator travels, wherein said heat sensing drive shaft comprises an upper end portion and a heat conducting shaft, said upper end portion comprising a stopper portion and a large radius portion, one surface of each said portion being formed so as to contact one surface of the other said portion, and the other surface of said stopper portion being contacted to the lower surface of said diaphragm and the other surface of said large radius portion being equipped with said heat conducting shaft; and said large radius portion is formed to be separated from said power element.

Said expansion valve is characterized in that said stopper portion is equipped with a refrigerant collecting means.

Said expansion valve is characterized in that said collecting means is a penetrating hole which penetrates said stopper portion.

Further, the present invention characterizes in an expansion valve comprising a power element portion filled with a predetermined refrigerant, a diaphragm constituting one wall surface of said power element portion which is displaced in correspondence to the change in pressure of said power element portion, a heat sensing drive shaft for transmitting the temperature of said refrigerant flowing out from an evaporator to said diaphragm, and a valve to which said displacement of the diaphragm is transmitted by said heat sensing drive shaft for controlling the flow rate of said refrigerant flowing into said evaporator, wherein the upper end portion of said heat sensing drive shaft comprises a stopper portion for contacting to said diaphragm, said upper end portion being formed so as to separate from said power element portion by leaving said stopper portion inside said power element portion.

Moreover, the present invention characterizes in an expansion valve comprising a power element portion filled with a predetermined refrigerant, a diaphragm constituting one wall surface of said power element portion which is displaced in correspondence to the change in pressure of said power element portion, a heat sensing drive shaft for transmitting the temperature of said refrigerant flowing out from an evaporator to said diaphragm, and a valve to which said displacement of the diaphragm is transmitted by said heat sensing drive shaft for controlling the flow rate of said refrigerant flowing into said evaporator, wherein the upper end portion of said heat sensing drive shaft includes a separating means for separation from said diaphragm, and said heat sensing drive shaft is positioned so that said separating means contacts said diaphragm.

Further, the center area of said separating means is positioned so as to contact said diaphragm, and the end portion thereof is made of a metal member and being held by said lower pressure chamber.

Said metal member comprises a portion formed by expanding the center area of a metal plate, said portion being positioned so as to contact said upper end portion, and the rim portion of said metal plate further comprises a bent portion so that said rim may be held by said lower pressure chamber.

Said metal member is characterized in that the center area of said metal member is staked and fixed to a convex portion formed on the center area of the upper end portion of said drive shaft, and the rim portion thereof being held by said lower pressure chamber.

Said separating means is equipped with a retrieving means for retrieving the predetermined refrigerant inside said power element portion.

Said metal member is equipped with a retrieving means for retrieving the predetermined refrigerant inside said power element portion.

PREFERRED EMBODIMENT OF THE INVENTION

The embodiment according to the present invention will now be explained with reference to the drawings.

Figure 1:
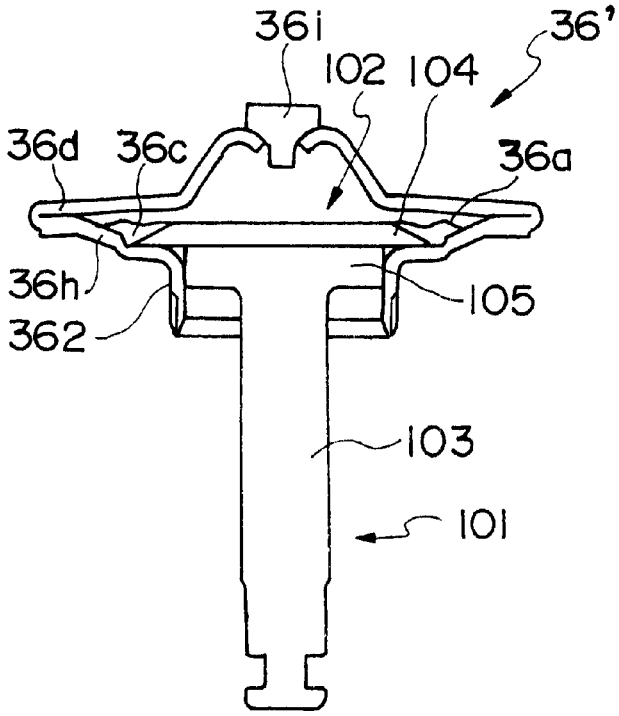
FIG. 1 is vertical cross-sectional view showing the main portion of the expansion valve according to one embodiment of the present invention.
Figure 16A:
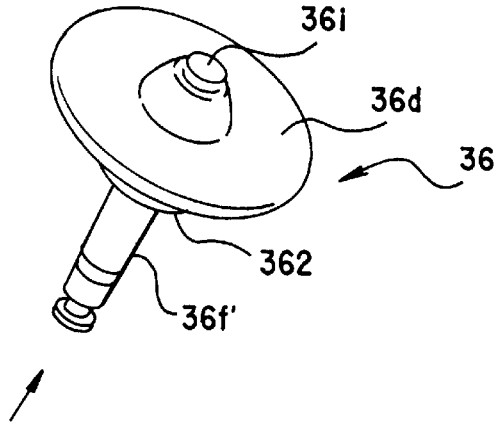
Fig.16(A) PRIOR ART
FIG. 16 is a schematic view and a vertical cross-sectional view showing the state where the power element portion of FIG. 15 is separated.
Figure 16B:
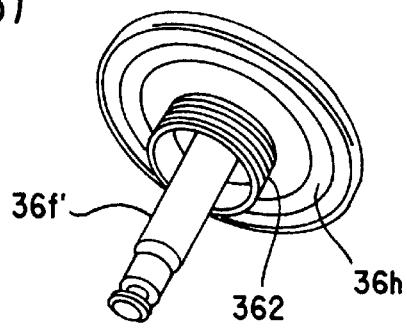
Fig.16(B) PRIOR ART
Figure 16C:
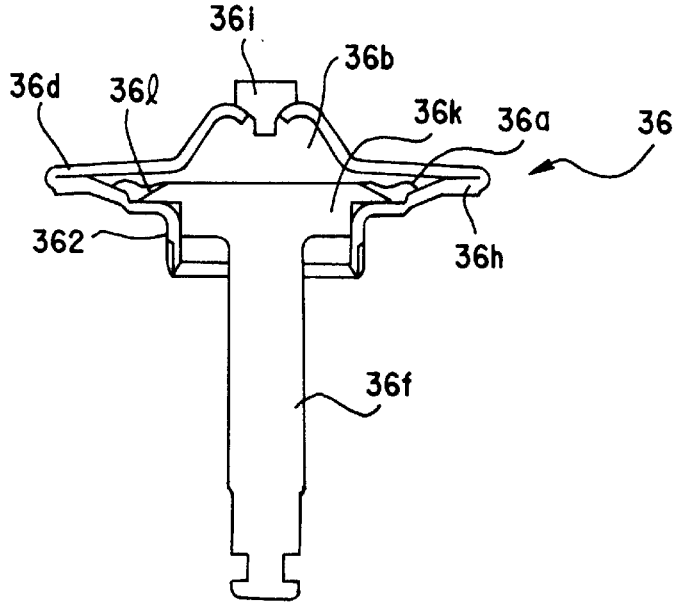
Fig.16(C) PRIOR ART

FIG. 1 is a vertical cross-sectional view showing the structure of the power element portion of the main portion of the expansion valve according to one embodiment of the present invention, and corresponds to the power element portion of the prior art expansion valve shown in FIG. 16(C).

Figure 15:
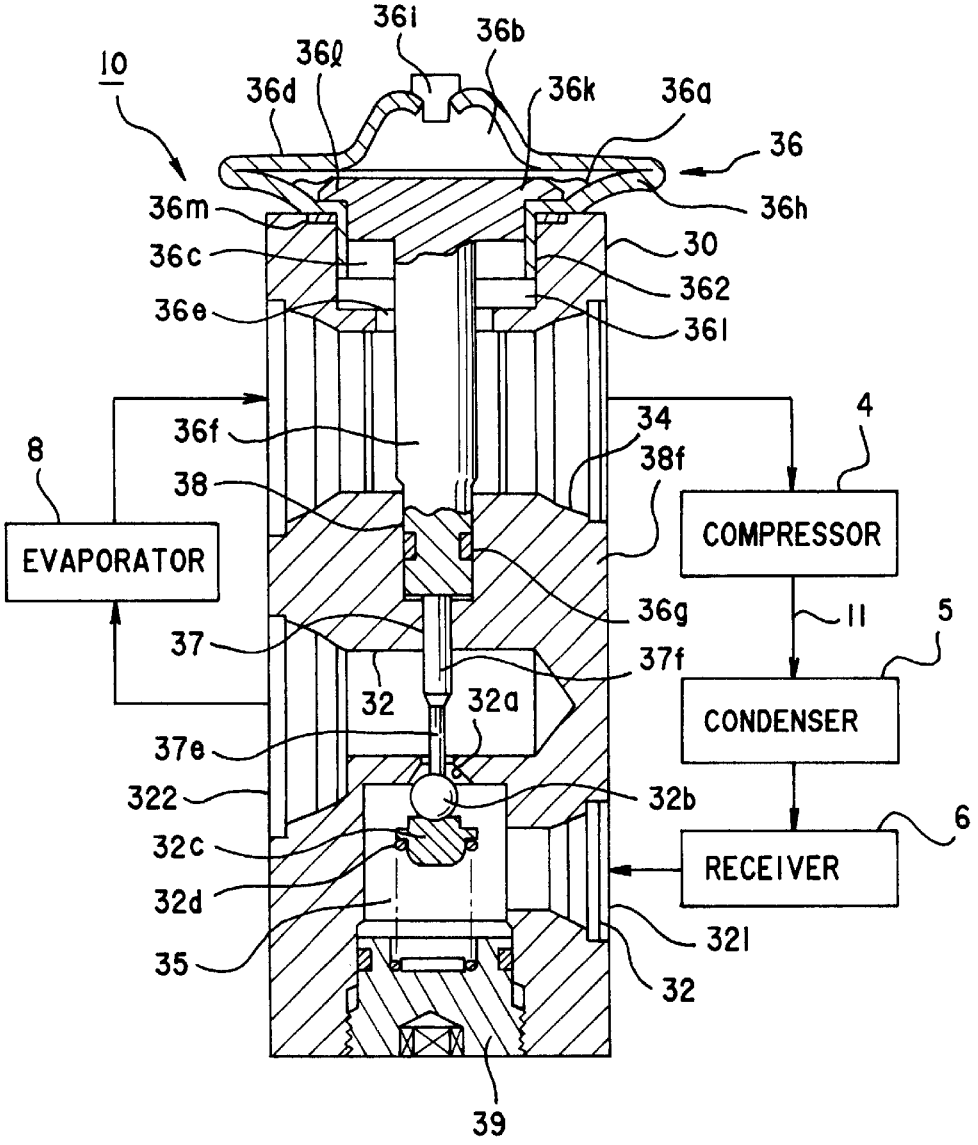
Fig.15 PRIOR ART
FIG. 15 is a vertical cross-sectional view showing the structure of the prior art expansion valve.

The expansion valve of the present invention shown in FIG. 1 and that of the prior art shown in FIG. 15 and FIG. 16(C) have the same structure except for the heat sensing drive shaft of the power element portion. Therefore, in the present embodiment, the power element portion will only be shown while the other structures will be omitted. Similarly, in the other embodiments of the expansion valve according to the present invention disclosed hereinafter, only the structure of the power element portion will be shown in a vertical cross-sectional view, with other structures omitted.

In FIG. 1, a power element portion 36' comprises a heat sensing drive portion 101 which differs from the heat sensing drive shaft **36*f* in the prior art, but the other structures are the same as the power element portion 36 of the prior art shown in FIG. 15, the explanation of which are omitted by providing the same reference numbers. That is, the heat sensing drive shaft 101 comprises an upper end portion 102 and a heat conducting shaft 103, wherein the upper end portion 102 includes a stopper portion 104 and a large radius portion 105, each having one surface contacted to one surface of the other. The other surface of the stopper portion 104 being enlarged to the radial direction contacts the lower surface of a diaphragm 36*a*, and the other surface of the large radius portion 105 is equipped with the heat conducting shaft 103 being integrally formed to the large radius portion 105**.

According to such structure, even if the power element portion 36' is composed of various metals, that is, if the blind plug **36*i*, the upper cover 36*d*, the lower cover 36*h* and the diaphragm 36*a* are formed of a stainless steel material and the large radius portion 105 and the heat conducting shaft 103 are formed of an aluminum metal, by utilizing a stainless steel material as the stopper portion 104, the various metals could be separated. That is, since the stopper portion 104 is enlarged to the radial direction and stopped by the lower cover 36*h*, the large radius portion 105 may be separated from the stopper portion 104, and the large radius portion 105 together with the heat conducting shaft 103 could be removed from the lower pressure chamber 36*c* of the power element portion 36' along the mounting seat 362**.

Figure 2:
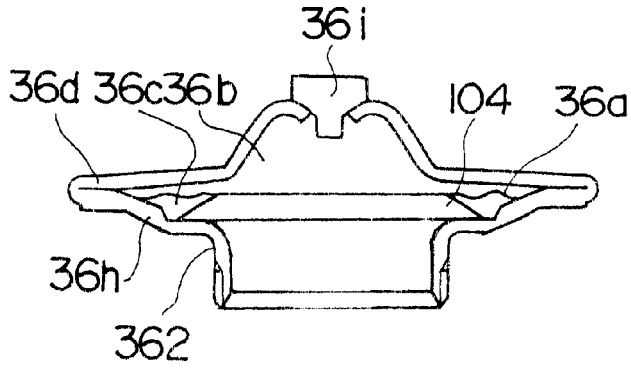
FIG. 2 is a vertical cross-sectional view and a schematic view showing the state where the power element of FIG. 1 is separated.
Figure 2:
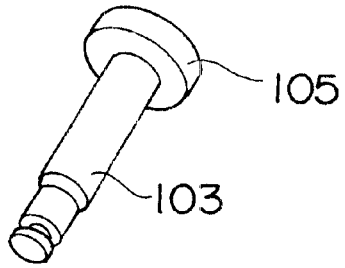

Therefore, according to the present embodiment, the metal portion made of stainless steel shown in FIG. 2(A) and the metal portion made of aluminum shown in FIG. 2(B)

may be separated. Accordingly, these materials may be separated and recycled.

Moreover, according to the present invention, by mounting a collecting means in advance for collecting the refrigerant to the metal portion made of stainless steel shown in FIG. 2(A) which is enabled to be recycled as explained above, the refrigerant could easily be collected.

Figure 3:
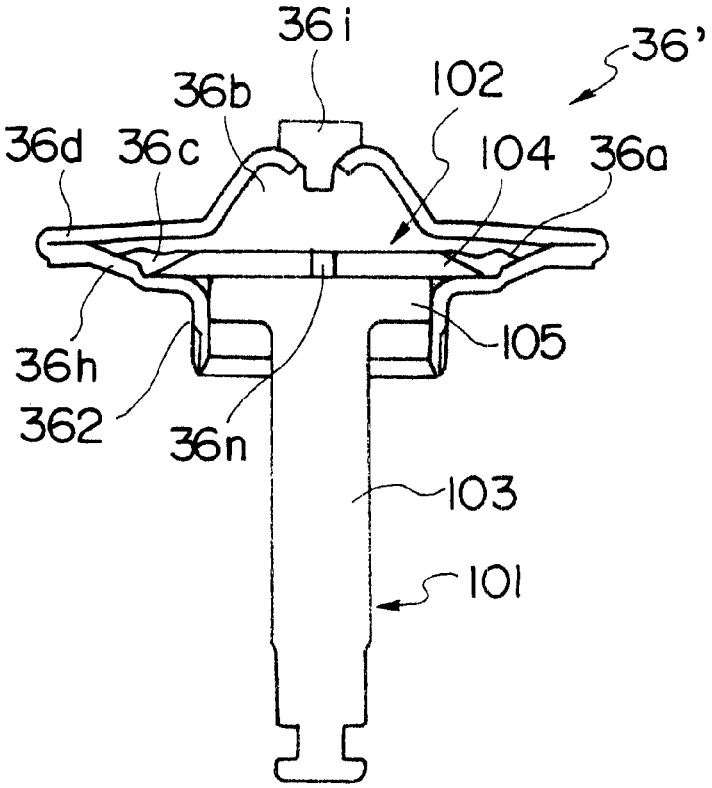
FIG. 3 is a vertical cross-sectional view equipped with the refrigerant collecting means on the main portion of the expansion valve according to the present invention.

That is, in the state where the metal portion is separated as shown in FIG. 2(A), the predetermined refrigerant being filled inside the upper pressure chamber 36*b* may be collected. By providing a penetrating hole 36*n* with a diameter of approximately 3 mm as the collecting means to the center portion and the like of the stopper portion 104 as shown in FIG. 3, the refrigerant could be collected in the separated state as shown in FIG. 4.

Moreover, even if the penetrating hole 36*n* is formed on the stopper portion 104, the expansion valve may perform the same movement since the penetrating hole 36*n* contacts the lower surface of the diaphragm 36*a* and will be covered by the diaphragm 36*a*.

Figure 4:
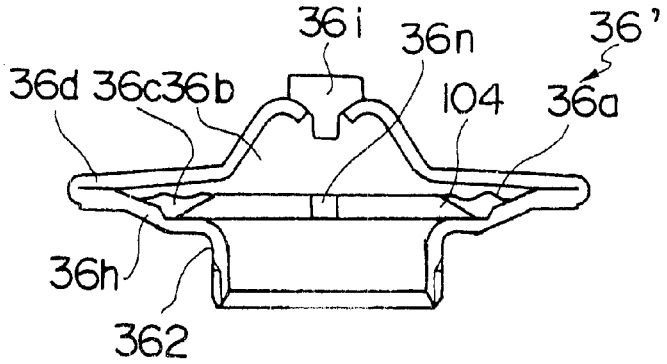
FIG. 4 is a vertical cross-sectional view explaining the way to collect refrigerant according to the refrigerant collecting means of FIG. 3.
Figure 5:
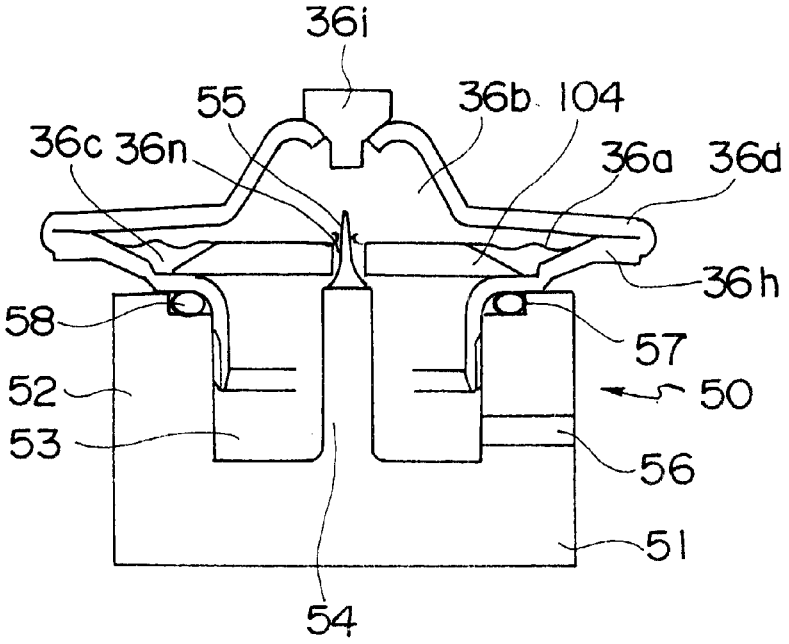
FIG. 5 is an explanatory view showing the method to collect the refrigerant from the refrigerant collecting means shown in FIG. 4 by use of a jig.

In the structure shown in FIG. 4, a jig or the like shown in FIG. 5 is used to collect the predetermined gas.

In FIG. 5, the metallic jig 50 is formed to have a cylindrical shape, comprising a disk-shaped bottom 51, an outer wall 52 formed on said bottom in the circumference area, an interior space 53 surrounded by the outer wall 52, and a convex portion 54 mounted inside the interior space 53 with a needle portion 55 mounted on the tip end thereof. On the outer wall 52 is formed a side hole 56 communicated to the interior space 53. On the upper end of the outer wall 52 of the jig 50 is formed a step portion 57, and the lower cover 36*h* shown in FIG. 4 is mounted on the upper end of the surrounding outer wall 52 through an o-ring 58 placed inside said step portion 57 as sealing means.

At this time, the needle portion 55 on the convex portion 54 is mounted inside the interior space 53 corresponding to the position of the penetrating hole 36*n* formed on the stopper 104. By pressing the power element 36, the needle portion 55 advances inside the penetrating hole 36*n*, breaking the diaphragm 36*a* formed of a metallic thin-film having flexibility (for example, a stainless steel plate having a plate thickness of approximately 0.1 mm) by the needle 55. As a result, the interior space 53 of the jig 50 and the upper pressure chamber 36*b* will be communicated through the penetrating hole 36*n*, and the refrigerant inside the upper pressure chamber 36*b* becomes confined inside the interior space 53 of the jig 50. This refrigerant will be sucked into a refrigerant collecting device not shown through the side hole 56 communicated to the interior space, and thereby, the refrigerant could be collected.

Further, either manual or automatic means may be used to press the power element 36*h* mounted to the jig 50.

Figure 6:
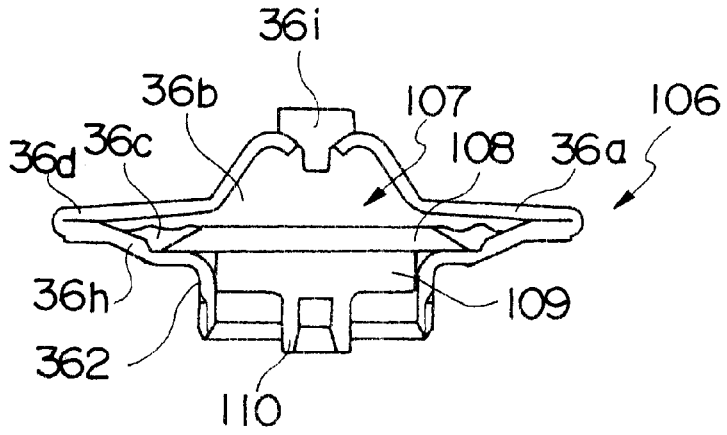
FIG. 6 is a vertical cross-sectional view showing the structure of the main portion of the expansion valve according to another embodiment of the present invention.

FIG. 6 is a vertical cross-sectional view of a power element portion 106 showing the main portion of the expansion valve according to another embodiment of the present invention, and corresponds to the power element portion 36 of the prior art expansion valve 10 shown in FIG. 16. Only the upper end portion 107 of the present expansion valve shown in FIG. 6 differs from the upper end portion 36*k* of the prior art expansion valve 100, so the explanation of the other members having the same reference numbers as that of the prior art expansion valve 100 are omitted.

In FIG. 6, the upper end portion 107 comprises a stopper portion 108 and a large radius portion 109 each having one surface contacting one surface of the other member, and the other surface of the stopper portion 108 being enlarged to the radial direction contacts the lower surface of the diaphragm 36*a*, and the other surface of the large radius portion 109 is equipped with a protrusion 110 which is integrally formed to the large radius portion 109, the interior of which is contacted to the upper end of the rod portion 316.

According to such structure, even if the power element portion 106 is formed of various metal materials, that is, if the blind plug 36*i*, the upper cover 36*d*, the lower cover 36*h* and the diaphragm 36*a* are formed of a stainless steel, and the large radius portion 109 is made of aluminum metal, the different metal materials could be separated by utilizing a stainless steel material as the stopper portion 108.

Figure 7:
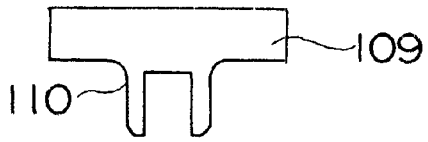
FIG.7 is a cross-sectional view of the large radius portion of FIG. 6.

That is, since the stopper portion 106 is enlarged to the radial direction and held by the lower cover 36*h*, only the large radius portion 109 could be separated from the stopper portion 108 and removed from the lower pressure chamber 36*c* along the mounting seat 362. Therefore, according to the present embodiment, the large radius portion 109 made of aluminum may be separated as shown in FIG. 7. Accordingly, the different metal materials could each be separated and recycled.

Moreover, in the embodiment shown in FIG. 6, in order to collect the refrigerant being filled inside the upper pressure chamber 36*b*, a penetrating hole similar to that of the penetrating hole 36*n* shown in FIG. 3 may be formed to the stopper portion 108 of the embodiment shown in FIG. 6, and the refrigerant could be collected by utilizing the jig shown in FIG. 5.

The above explanation referred to the structure for separating the stopper portion and the large radius portion in the embodiment of the expansion valve according to the present invention. However, the present invention is not limited to such structure, but could utilize a separating means for separating the upper end portion of the heat sensing drive shaft from the diaphragm.

Figure 8:
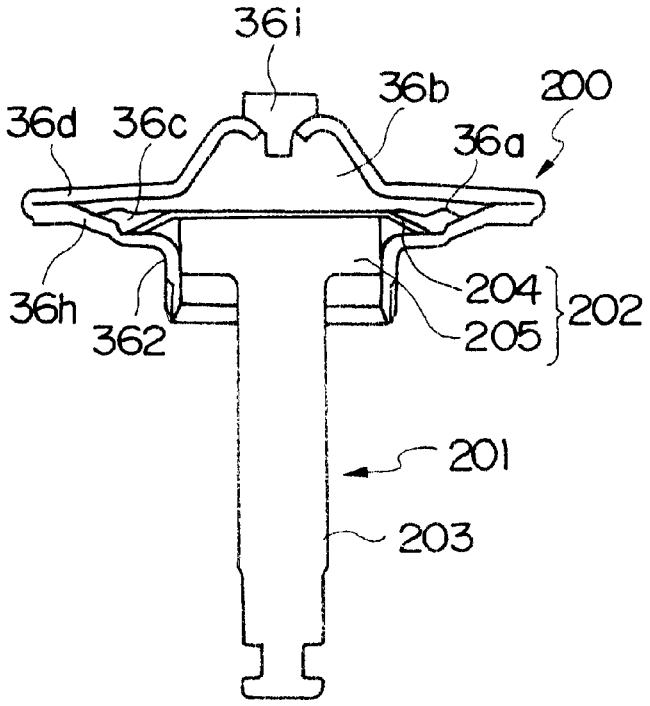
FIG. 8 is a vertical cross-sectional view showing the structure of the main portion of the expansion valve according to yet another embodiment of the present invention.

FIG. 8 is a vertical cross-sectional view of a power element portion 200 showing the main portion of yet another embodiment of the expansion valve according to the present invention, showing the example of utilizing a plate-like disk-shaped member made of metal material as said separating means. In the embodiment shown in FIG. 8, the structure except for the heat sensing drive shaft is the same as the power element portion 36 of the prior art expansion valve shown in FIG. 16(C).

That is, a heat sensing drive shaft 201 comprises an upper end portion 202 and a heat conducting shaft 203, wherein the upper end portion 202 comprises a plate-like member 204 and a large radius portion 205 each having one surface contacting one surface of the other member. The center portion on the other surface of the plate-like member 204 contacts the center portion of the lower surface of the diaphragm 36*a*, and the end portion of the plate-like member 204 is bent so as to be held by the lower pressure chamber 36*c* and positioned so as to contact the lower cover 36*h*.

In other words, the plate-like member 204 is positioned between the lower surface of the diaphragm 36*a* and the large radius portion 205, so as to contact the diaphragm 36*a* and the large radius portion 205. On the other surface of the large radius portion 205 is integrally equipped a heat conducting shaft 203.

According to such structure, even when the blind plug 36*i*, the upper cover 36*d*, the lower cover 36*h* and the diaphragm 36*a* are formed of a stainless steel material, and the large radius portion 205 is made of aluminum metal, the different metal materials could be separated by utilizing a stainless steel with a plate thickness of few millimeters, for example 2 mm, as the plate-like member 204.

That is, since the plate-like member 204 is held by the lower cover 36*h*, only the large radius portion 205 could be separated from the plate-like member 204, so the large radius portion 205 and the heat conducting shaft 203 may both be removed from the lower pressure chamber 36*c* of the power element 200 along the mounting seat 362.

Figure 9:
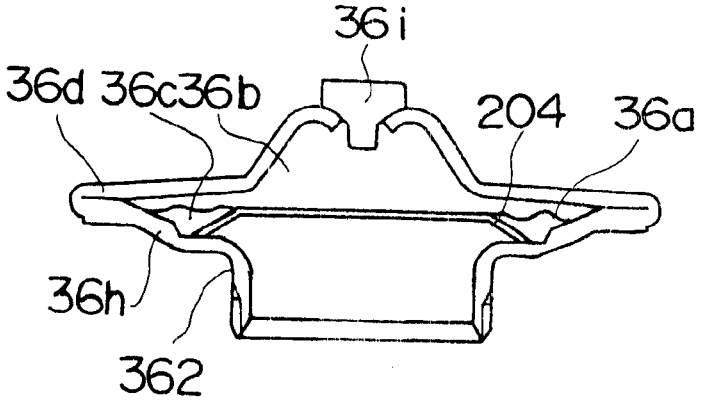
FIG. 9 is a vertical cross-sectional view and a schematic view showing the state where the power element portion of FIG. 8 is separated.
Figure 9:
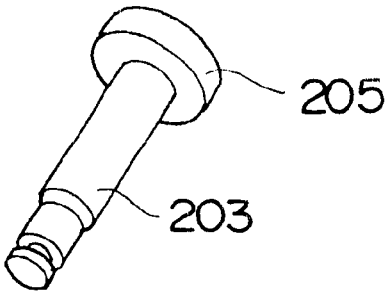

As explained, according to the present embodiment, the metal member made of stainless steel shown in FIG. 9(A) and the metal member made of aluminum shown in FIG. 9(B) could be separated. Therefore, these metals could each be segregated and recycled.

Moreover, according to the present invention, the refrigerant filled inside the upper pressure chamber 36*b* may also be collected in the separated state shown in FIG. 9(A).

Figure 10:
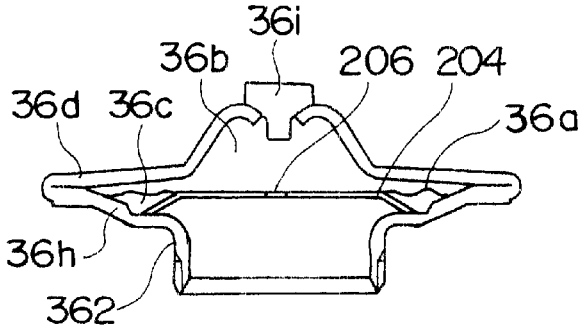
FIG. 10 is a vertical cross-sectional view explaining the way to collect the refrigerant by the refrigerant collecting means.

That is, in the center portion of the plate-like member 204 shown in the embodiment of FIG. 8, a penetrating hole having a diameter of approximately 3 mm or the like is formed in advance. When in the state where the members are separated as shown in FIG. 10, a penetrating hole 206 exists on the plate-like member 204.

Figure 11:
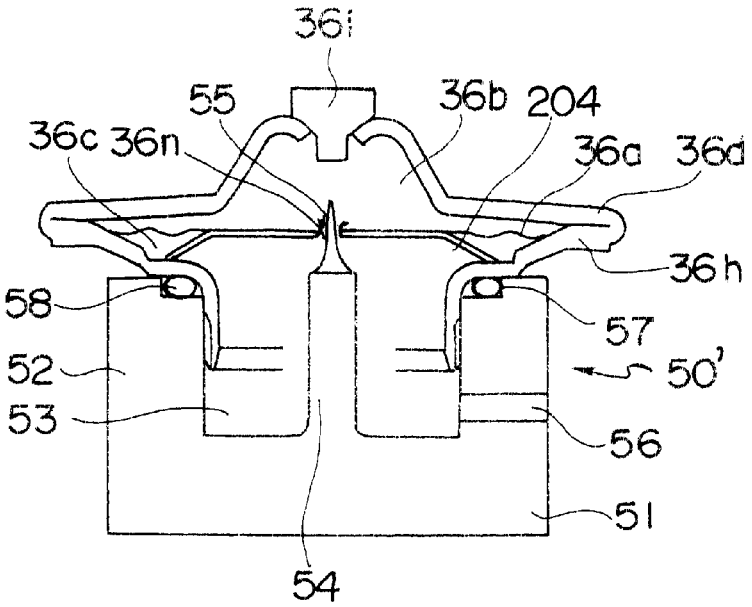
FIG. 11 is an explanatory view showing the method to collect refrigerant from the refrigerant collecting means shown in FIG. 10 by use of a jig.

Accordingly, the refrigerant inside the chamber 36*b* may be collected by the same method as the collecting method shown in FIG. 5 and utilizing a jig 50' as shown in FIG. 11. Further, even when the penetrating hole 206 is formed on the plate-like member 204, the plate-like member 204 contacts the lower surface of the diaphragm 36*a*, so the penetrating hole 206 is covered by the diaphragm 36*a* and covered therewith. Therefore, the expansion valve could be operated just like the prior art expansion valve. The jig 50' of FIG. 11 is the same as the jig 50 shown in FIG. 5, so the same members are shown by the same reference numbers, and the explanations thereof are omitted.

Figure 12:
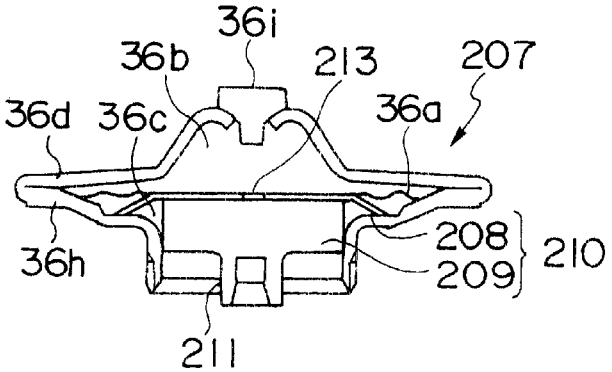
FIG. 12 is a vertical cross-sectional view showing the main structure of the expansion valve according to yet another embodiment of the present invention.
Figure 17:
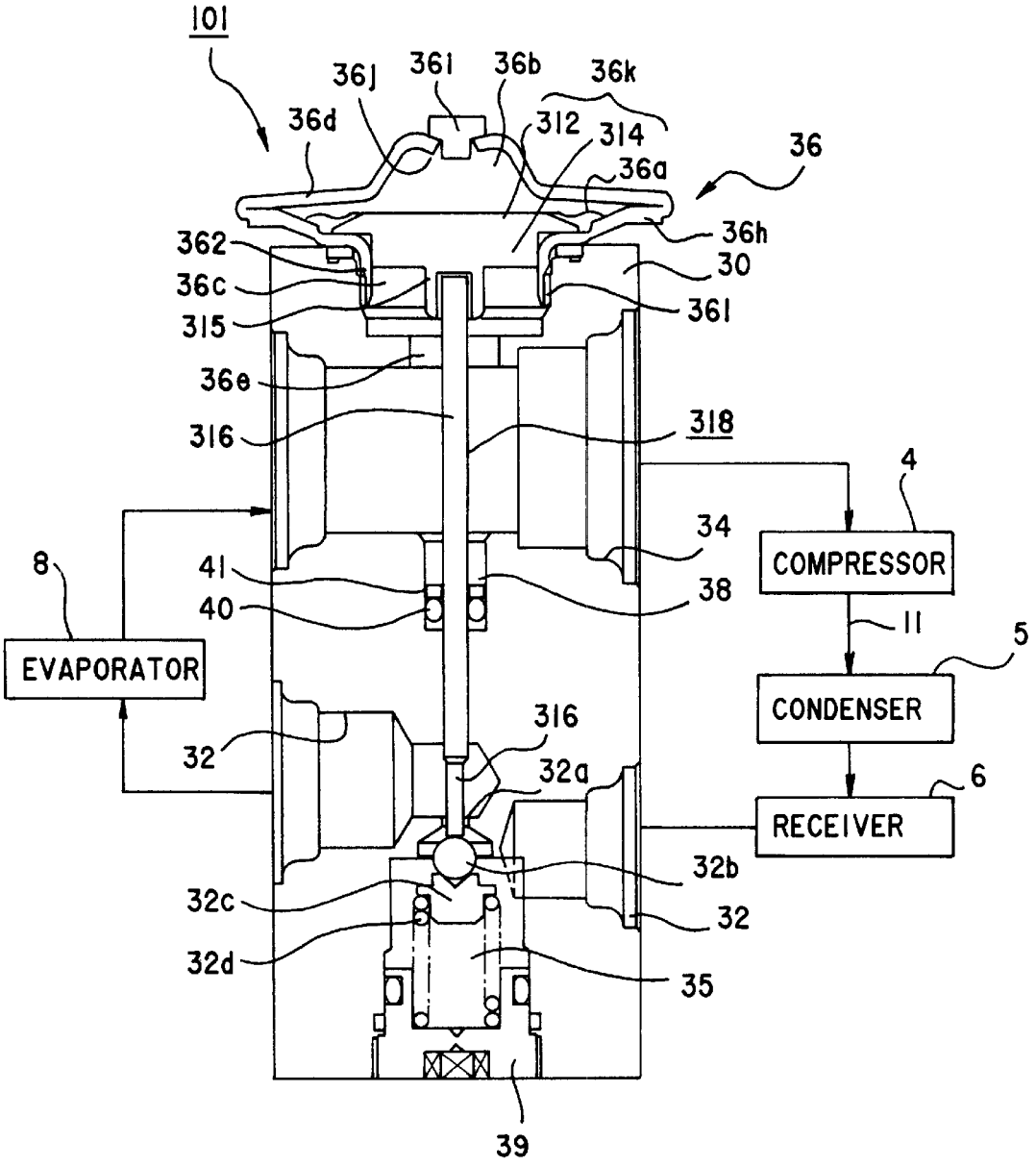
Fig.17 PRIOR ART
FIG. 17 is a cross-sectional view showing the structure of another prior art expansion valve.
Figure 18A:
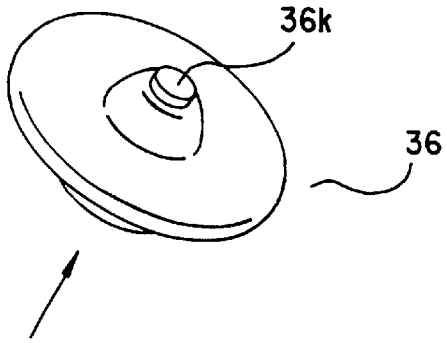
Fig.18(A) PRIOR ART
FIG. 18 is a schematic view and a vertical cross-sectional view showing the state where the power element portion of FIG. 17 is separated.
Figure 18B:
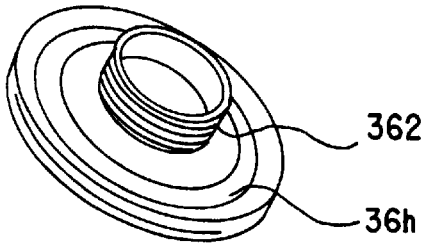
Fig.18(B) PRIOR ART
Figure 18C:
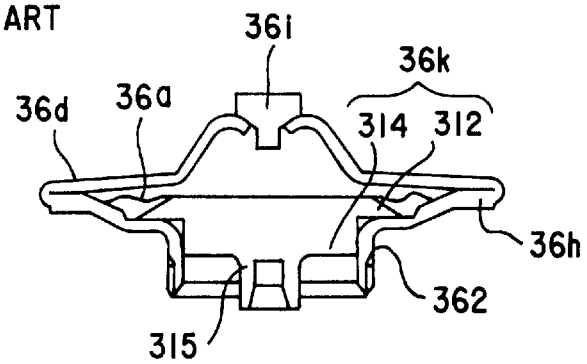
Fig.18(C) PRIOR ART

FIG. 12 is a vertical cross-sectional view of a power element portion 207 showing the main portion of the expansion valve according to yet another embodiment of the present invention, wherein the structure of the power element portion 207 only differs in the structure of an upper end portion 210 from the power element portion 36 of the prior art expansion valve shown as the main portion in FIG. 17(C), and the other structures are the same. Accordingly, the same members are provided with the same reference numbers as the prior art structure, and the explanations thereof are omitted.

In FIG. 12, the upper end portion 210 comprises a plate-like member 208 and a large radius portion 209 similar to the embodiment shown in FIG. 8, and the plate-like member 208 and the large radius portion 209 each have one surface contacting one surface of the other member, and the center portion of another surface of the plate-like member 208 contacts the center portion on the lower surface of the diaphragm 36*a*, and the rim portion of the plate-like, member 208 is bent so as to be held by the lower pressure chamber 36*c* and positioned so as to contact the lower cover 36*h*. The other surface of the large radius portion 209 is equipped with an integrally formed protrusion 211.

The plate-like member 208 has one surface contacting the large radius portion 209 and the other surface contacting the lower surface of the diaphragm 36*a*, so accordingly, the plate-like member 208 is positioned between the diaphragm 36*a* and the large radius portion 209. According to such structure, even when the blind plug 36*i*, the upper cover 36*d*, the lower cover 36*h* and the diaphragm 36*a* are formed of a stainless steel material, and the large radius portion 209 is made of an aluminum or brass metal, the different metal materials could be separated by utilizing a stainless steel with a plate thickness of few millimeters, for example 2 mm, as the plate-like member 208.

Therefore, the plate-like member 208 is held at its end portion by the lower cover 36*h*, so only the large radius portion 205 may be separated from the plate-like member 208 and the large radius portion 209 may be removed from the lower pressure chamber 36*c* of the power element portion 207 along the mounting seat 362.

Figure 13:
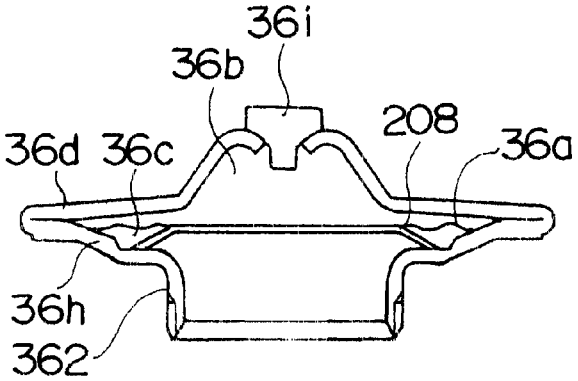
FIG. 13 is a vertical cross-sectional view and a schematic view showing the state where the power element portion is separated in FIG. 12.
Figure 13:
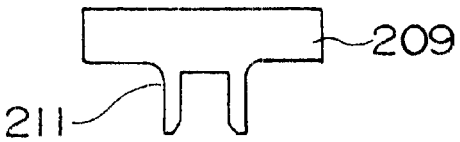

According to the present embodiment, the power element portion 207 could be separated into a metal portion made of stainless steel as shown in FIG. 13(A) and a metal portion made of aluminum or brass as shown in FIG. 13(B). Therefore, these materials could each be segregated and recycled.

Moreover, according to the embodiment shown in FIG. 12, 213 shows a penetrating hole formed on the plate-like member 213, and the penetrating hole 213 is formed to have a diameter of approximately 3 mm, which may be used for collecting the refrigerant filled inside the upper pressure chamber 36*b* of the power element portion 207. The collection of this refrigerant utilizes a jig as explained in FIG. 11, and is performed by the same method.

FIGS. 14(A), 14(B), 14(C) and 14(D) show the structure of the power element portion which is the main member of the expansion valves according to yet other embodiments of the present invention. The embodiment shown in FIG. 14(A) and FIG. 14(B) only differ from that of FIG. 8 in the structure of the plate-like member and the large radius member, and the other structures are the same. The same members are shown by the same reference numbers, and the explanations thereof are omitted. Further, in the embodiment shown in FIG. 14(C) and FIG. 14(D), only the plate-like member and the large radius member differs from the embodiment shown in FIG. 12, and the other structures are the same. The same members are shown by the same reference numbers, and the explanations thereof are omitted.

Figure 14:
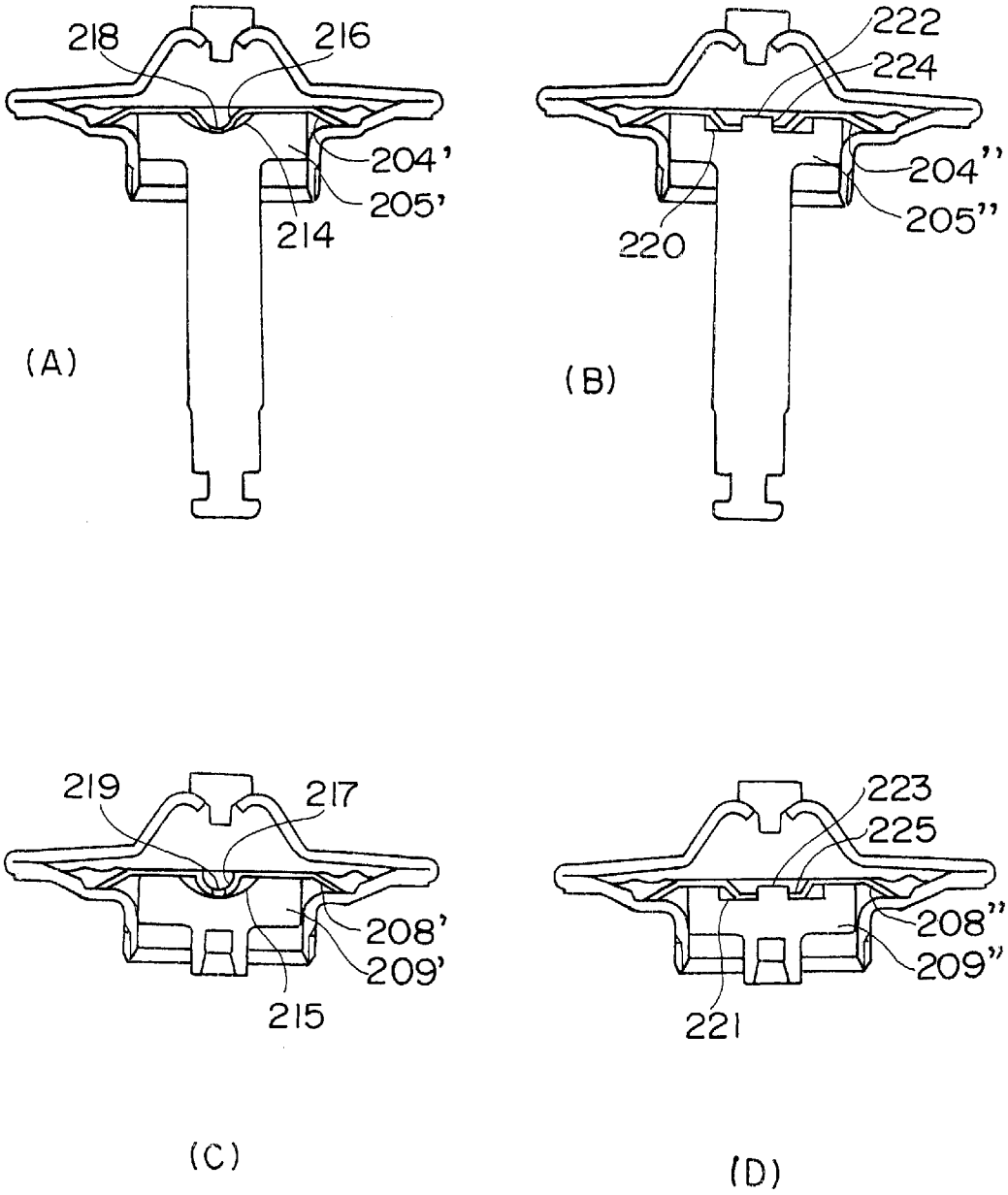
FIG. 14 is a vertical cross-sectional view explaining other shapes of the metal members shown in FIG. 8 or FIG. 12.

In the embodiments shown in FIG. 14(A) and FIG. 14(C), a concave portion 214 or 215 is formed on the center of the large radius portion 205' or 209' on the surface contacting the plate-like member 204' or 208'. On the center of the plate-like member 204' or 208' is formed a convex-shaped portion 216 or 217 which extends in the direction to contact the concave portion 214 or 215.

According to such embodiments, there is an advantage in that the plate-like member 204' and 208' may be contacted to the large radius portion 205' or 209' by adjusting the center to the convex-shaped portion.

Moreover, the peak portion of the convex-shaped portion 216 or 217 of the plate-like member 204' or 208' is formed a penetrating hole 218 or 219 similar to the penetrating holes mentioned before for collecting refrigerant. In the embodiments shown in FIG. 14(B) and FIG. 14(D), a convex portion 220 or 221 is formed on the large radius portion 205" or 209" on the surface contacting the plate-like member 204" or 208", and on the center area of the concave portion 220 or 221 is formed a convex portion 222 or 223. A disk-shaped small hole 224 or 225 formed on the center area of the plate-like member 204" or 208" is fit to the convex portion 222 or 223, and the plate-like member 204" or 208" is fixed thereto by staking.

According to such structure, there is an advantage in that the plate-like member 204" or 208" may strongly contact the large radius portion 205" or 209". According further to the embodiments shown in FIG. 14(B) and FIG. 14(D), the small hole 224 or 225 formed on the plate-like member 204" or 208" could be utilized as the penetrating hole for collecting refrigerant through which the needle portion 55 on the jig 50' shown in FIG. 5 penetrates, so there is an advantage in that there is no need to further mount a penetrating hole.

According to the embodiments shown in FIGS. 13(A) through 13(D), the members formed of different metals may be separated from each other in the same method as the other embodiments mentioned before by use of the plate-like member 204', 204", 208' or 208".

As explained, the expansion valve according to the present invention is formed so that the different kinds of metal material could be separated easily, so the metal materials could be segregated and recycled.

Moreover, the expansion valve according to the present invention may realize such recycle by separating the large radius portion and the stopper portion contacting the diaphragm, so there is no need to change the structure of the prior art expansion valve greatly.

Moreover, by utilizing a separating means for separating the upper endportion of the heat sensing drive shaft contacting the diaphragm from the diaphragm, and by applying a metal corresponding to the various metals to be recycled as the separating means, the power element portion and the heat sensing drive shaft which are the main portions of the expansion valve may be formed by combining appropriate kinds of metal materials.

Even further, according to the expansion valve of the present invention, the recycle of the metal materials may also enable a simple collection of the refrigerant, so not only the saving of resources but also the collection of regulated refrigerant may be promoted.

What is claimed is:

1. An expansion valve comprising:

a valve body, a power element seated at the top of the valve body having, a body for housing a diaphragm, the diaphragm made of stainless steel located in the interior of the power element forming a sealing wall separating an upper pressure chamber and a lower pressure chamber, said power element forming a head of the valve and filled with a heat sensing refrigerant, a heat sensing drive shaft made of aluminum extending from the diaphragm through a lower end of the body of the power element into the valve body, a valve, at the end of the heat sensing drive shaft opposite the diaphragm, driven in correspondence to the displacement of said diaphragm by the heat sensing drive shaft for changing a flow path area of an orifice through which a refrigerant to be sent to an evaporator travels, said heat sensing drive shaft further includes, a stainless steel stopper portion contacted to said diaphragm on an upper end and connected, so as to be removable therefrom, to the heat sensing drive shaft on a lower end.

2. An expansion valve comprising:

a valve body having, a first passage through which a high-pressure refrigerant travels, and a second passage through which a low-pressure refrigerant travels, a valve positioned inside said valve body for controlling the flow of the refrigerant traveling through said first passage, a power element mounted to the upper end of said valve body, a biasing means positioned in the lower portion of said valve body for biasing said valve, and an aluminum heat sensing drive shaft mounted between said power element and said valve, power element comprises, an upper pressure chamber, a lower pressure chamber, and a stainless steel diaphragm mounted in the interior of the power element dividing the upper pressure chamber and the lower pressure chamber;

the drive shaft comprises, a stainless steel stopper portion formed on the upper end thereof for contacting to said diaphragm; and a heat sensing shaft connected to a lower end of the stopper and removable therefrom.

3. An expansion valve comprising:

a valve body, a power element seated at the top of the valve body having, a body for housing a diaphragm, the diaphragm made of stainless steel located in the interior of the power element forming a sealing wall separating an upper pressure chamber and a lower pressure chamber, said power element forming a head of the valve and filled with a heat sensing refrigerant, an aluminum heat sensing drive shaft extending from the diaphragm through a lower end of the body of the power element into the valve body, a valve, at the end of the heat sensing drive shaft opposite the diaphragm, driven in correspondence to the displacement of said diaphragm by the heat sensing drive shaft for changing a flow path area of an orifice through which a refrigerant to be sent to an evaporator travels, the heat sensing drive shaft comprises:

an upper end portion, and a heat conducting shaft, said upper end portion comprising a stainless steel stopper portion and an aluminum large radius portion integrally formed on the top of the heat conducting shaft, one surface of each said portion being formed so as to contact one surface of the other said portion, and the other surface of said stopper portion being connected to a lower surface of said diaphragm and the other surface of said large radius portion being integrally formed on said heat conducting shaft; and said large radius portion is formed to be removable from said power element.

4. An expansion valve according to claim 1, claim 2 or claim 3, wherein said stopper portion is equipped with a refrigerant collecting means.

5. An expansion valve according to claim 1, claim 2 or claim 3, wherein said stopper portion is equipped with a refrigerant collecting means being a penetrating hole which penetrates said stopper portion.

6. An expansion valve comprising a power element portion filled with a predetermined refrigerant, a diaphragm constituting one wall surface of said power element portion which is displaced in correspondence to the change in pressure of said power element portion, a heat sensing drive shaft for transmitting the temperature of said refrigerant flowing out from an evaporator to said diaphragm, and a valve to which said displacement of the diaphragm is transmitted by said heat sensing drive shaft for controlling the flow rate of said refrigerant flowing into said evaporator:

wherein the upper end portion of said heat sensing drive shaft comprises a stopper portion for contacting to said diaphragm, said upper end portion being formed so as to separate from said power element portion by leaving said stopper portion inside said power element portion.

* * * * *